US009567831B2

(12) United States Patent
Ward et al.

(10) Patent No.: US 9,567,831 B2
(45) Date of Patent: Feb. 14, 2017

(54) CASING MOUNTED METERING DEVICE

(71) Applicants: Ryan Ward, Cypress, TX (US); Henry Joe Jordan, Jr., Willis, TX (US); Khai Tran, Pearland, TX (US)

(72) Inventors: Ryan Ward, Cypress, TX (US); Henry Joe Jordan, Jr., Willis, TX (US); Khai Tran, Pearland, TX (US)

(73) Assignee: Downhole Innovations, LLC, Houston, TX (US)

( * ) Notice: Subject to any disclaimer, the term of this patent is extended or adjusted under 35 U.S.C. 154(b) by 443 days.

(21) Appl. No.: 14/219,658

(22) Filed: Mar. 19, 2014

(65) Prior Publication Data

US 2014/0284060 A1 Sep. 25, 2014

Related U.S. Application Data

(60) Provisional application No. 61/803,600, filed on Mar. 20, 2013.

(51) Int. Cl.
*E21B 34/06* (2006.01)
*E21B 43/12* (2006.01)

(52) U.S. Cl.
CPC ..... *E21B 34/063* (2013.01); *E21B 43/12* (2013.01)

(58) Field of Classification Search
CPC ..... E21B 34/08; E21B 34/063; E21B 21/106; E21B 21/103; F16K 13/06; F16K 17/14–17/1633; F16K 17/40
USPC ..... 166/242.5; 138/104
See application file for complete search history.

(56) References Cited

U.S. PATENT DOCUMENTS 4,360,064 A * 11/1982 O'Connor, III ..... E21B 34/10 166/319
4,711,301 A * 12/1987 Stringfellow ..... E21B 33/127 166/187
2012/0273055 A1* 11/2012 Lirette ..... E21B 21/103 137/14

OTHER PUBLICATIONS

International Search Report, PCT/US2014/31228, Aug. 18, 2014.

* cited by examiner

*Primary Examiner* — Robert E Fuller
*Assistant Examiner* — David Carroll
(74) *Attorney, Agent, or Firm* — The Kubiak Law Firm PLLC

(57) ABSTRACT

The present invention relates to an inflow control device for controlling the flow of fluid into a tubular deployed in a wellbore comprising coupling between joints of tubulars. The inflow control device is mounted transversely through the coupling in any inflow can control devices the initial condition fluid flow between the exterior and interior of the tubular is prevented. As sufficient pressure is exerted upon the inflow control device from the interior of the tubular the inflow control device is actuated to allow fluid flow between the interior and exterior the tubular. A nozzle in the inflow control device allows fluid to pass at a preset rate. The present invention furthermore relates to a method of assembling an inflow control device according to the invention and to a completion system comprising an inflow control device according to the invention

4 Claims, 11 Drawing Sheets

CASING MOUNTED METERING DEVICE

CROSS-REFERENCE TO RELATED APPLICATIONS

This application claims priority to U.S. Provisional Patent Application No. 61/803,600 that was filed on Mar. 20, 2013.

FIELD OF INVENTION

Embodiments of the present invention generally relate to methods and apparatuses for a downhole operation. More particularly, the invention relates to methods and apparatuses for controlling the flow of fluids from a hydrocarbon formation into the interior of the tubular.

BACKGROUND

When producing an oil or gas well is desirable to control the fluid flow into or out of the production tubular, for example, to balance inflow or outflow of fluids along the length of the well. For instance, some horizontal wells have issues with a heel and toe effect, where differences in pressure or the amount of the various fluids that are present at a particular location can lead to premature gas or water breakthrough significantly reducing the production from the reservoir. Inflow control devices have been positioned in the completion string at the heel of the well to stimulate inflow at the toe and balance fluid inflow along the length of the well. In another example, different zones of the formation accessed by the well can produce at different rates. Inflow control devices may be placed in the completion string to reduce production from high producing zones, and thus stimulate production from low or non-producing zones.

SUMMARY

The concepts described herein encompass various types of inflow control devices. In one embodiment a first hole is bored transversely, or across the sidewall, in a coupling. A second hole is bored from or otherwise formed in the interior of the coupling to intersect the first hole in the sidewall of the coupling. The two holes cooperate to permit fluid communication between the interior of the tubing and annulus. A housing having a throughbore and a piston that is pinned, with the shear pin, in the housing throughbore is inserted into the first hole and locked in place typically by threads on the exterior of the housing that match threads on the interior of the first hole. Typically the piston is sized so that one end may fit into the housing throughbore while the other end is sized to fit into the first hole. Additionally, the end of the piston sized to fit in the first hole has a circumferential groove cut into the periphery so that a seal may be placed in the circumferential groove thereby sealing the piston against fluid leaking past the piston towards the exterior of the tubular. Finally a biasing device, such as a spring, is added to bias the piston away from the housing.

In order to actuate the inflow control device described above, fluid pressure inside the tubular is increased in order to apply force to the end of the piston thereby forcing the piston further into the housing throughbore. The fluid pressure inside the tubular may be increased as many times as is required as long as the pressure necessary to shear the shear pin and to overcome the spring bias is not surpassed. However when sufficient pressure is applied to the interior of the tubular and the piston is forced to move further into the housing throughbore the shear pin is sheared releasing the piston toe move relatively freely in the housing throughbore. When the pressure inside of the tubular is released the bias device pulls the piston out of the housing throughbore allowing fluid access between the interior of the tubular and the exterior the tubular although the nozzle in the housing limits the amount of fluid that may pass.

In another embodiment of an inflow control device a first hole is formed transversely, or across the sidewall, in a coupling. A second hole is formed from the interior of the coupling to intersect the first hole in the sidewall of the coupling so that the two holes together permit fluid communication between the interior of the tubing and annulus. A housing having a throughbore is inserted into the first hole and locked in place typically by threads on the exterior of the housing that match threads on the interior of the first hole. In many instances a circumferential groove is cut in the housing allowing a seal to be inserted into the housing to seal the potential fluid pathway between the exterior of the housing and the first hole although in some instances the groove may be cut into the sidewall of the first hole. Typically the housing includes a rupture disc on the end of the housing towards the interior of the tubular. The rupture disc may be incorporated into the housing or may be a separate assembly as long as the rupture disc prevents fluid flow into the interior of the housing from the interior of the tubular when the fluid pressure in the interior of the tubular is below a specified pressure. The throughbore of the housing also incorporates a series of shoulders where the shoulders are arranged to support parts of the inflow control device placed on the shoulder from the exterior of the tubular, in other words the shoulders provide support for parts of the inflow control device to resist pressure applied from the exterior or annular region of the tubular. The first shoulder or the shoulder furthest away from the exterior of the tubing retains and supports an erodible or frangible support disc. The erodible support disc may have holes, aligned with the throughbore, that pass through the erodible support disk to allow fluid to pass through after the rupture disc ruptures. The second shoulder, slightly closer to the exterior of the tubing than the first shoulder supports a sealing disk. The sealing disk is supported by both the erodible support disc and the second shoulder. The sealing disk prevents fluid, including high-pressure fluid, from moving through the inflow control device from the exterior of the tubing towards the interior of the tubing. A nozzle is inserted into the through bore usually slightly closer to the exterior of the tubing the sealing disk to allow the nozzle to be easily replaced. In some instances the nozzle may be part of the through bore.

In order to actuate the inflow control device described above, fluid pressure inside the tubular is increased in order to rupture the rupture disc. The fluid from inside the tubular then flows past the rupture disc and to the erodible support disc. The fluid then flows through the holes in the erodible support disc allowing the fluid to apply force to the sealing disk. Typically the sealing disk is not supported, or maybe lightly supported, towards the exterior of the tubular allowing the fluid from the interior of the tubular to push the sealing disk out of the inflow control device. After the rupture disk and the sealing disk have been removed by fluid under pressure from the interior of the tubular fluid communication is established between the exterior to the interior of the tubular. Over time, as fluid passes through the holes in the erodible support disc, the erodible support disc dissolves or is eroded away allowing fluid to flow between the interior of the tubular and the exterior of the tubular at a flow rate determined by the nozzle in the throughbore.

In another embodiment of an inflow control device a first hole is formed transversely, or across the sidewall, in a coupling. A second hole is formed from the interior of the coupling to intersect the first hole in the sidewall of the coupling so that the two holes together permit fluid communication between the interior of the tubing and annulus. A housing having a throughbore is inserted into the first hole and locked in place, typically by threads, on the exterior of the housing that match threads on the interior of the first hole. In many instances a circumferential groove is cut in the housing or first hole sidewall to allow a seal to be inserted into the groove to seal the fluid pathway between the exterior of the housing and the first hole. A piston that is typically pinned with a shear pin in the housing throughbore is inserted into the first hole. Typically the piston is sized so that one end may fit into the housing throughbore while the other end is sized to fit into the first hole. Additionally the end of the piston sized to fit in the first hole may have a circumferential groove cut into the periphery so that a seal may be added sealing the piston into the first hole. An explosive charge including a primer is located in the housing throughbore on the side of the piston towards the annulus of the tubular. A charge seal is then placed in the housing throughbore on the side of the explosive charge towards the annulus of the tubular. The charge seal prevents fluid, including high-pressure fluid, from moving through the inflow control device from the exterior of the tubing towards the interior of the tubing. A nozzle may be included in the housing throughbore. In some instances the nozzle may be part of the through bore.

In order to actuate the inflow control device described above, fluid pressure inside the tubular is increased to a level that causes the piston to shear the shear pin thereby allowing the piston to move further into the housing throughbore. As the piston moves further into the housing throughbore the piston strikes or otherwise causes the primer to the fire causing the explosive charge to detonate. The force of the explosive charge detonating removes the charge seal and forces the piston out of the through bore. Fluid communication is thereby established between the exterior to the interior of the tubular. Overtime, as fluid passes through the holes in the erodible support disc, the erodible support disc dissolves or is eroded away allowing fluid to flow between the interior of the tubular and the exterior of the tubular at a flow rate determined by the nozzle in the through bore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
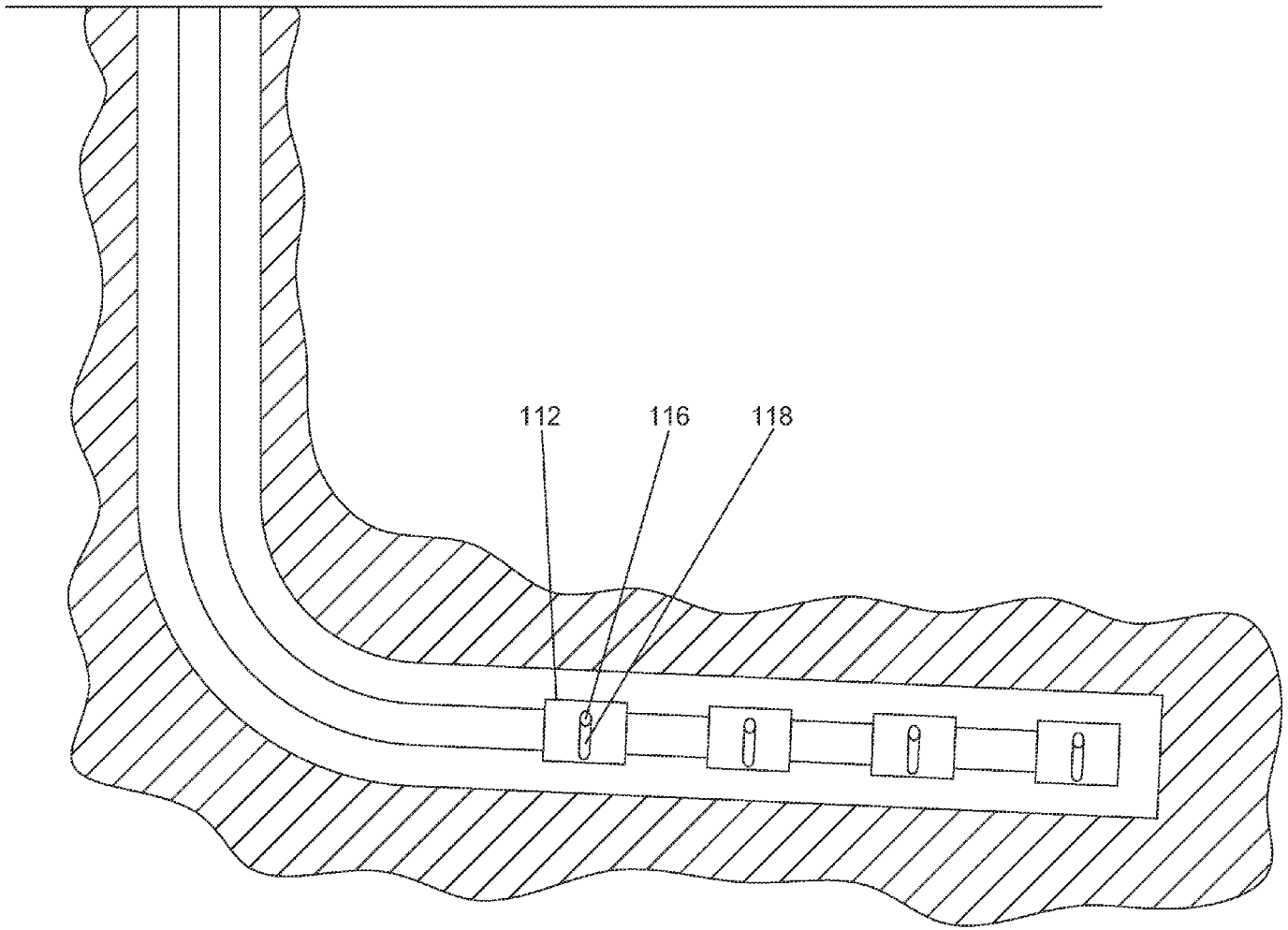
FIG. 1 depicts a tubing string having multiple couplings were each coupling incorporates an inflow control device.

As depicted in FIG. 1 an inflow control device 118 has been designed for use with a liner string completion in a deviated or horizontal application. Individual tubular joints of liner are joined using a threaded coupling 112. A first hole 116 has been drilled into the wall of the coupling 112 which houses the inflow control device 118.

Figure 2:
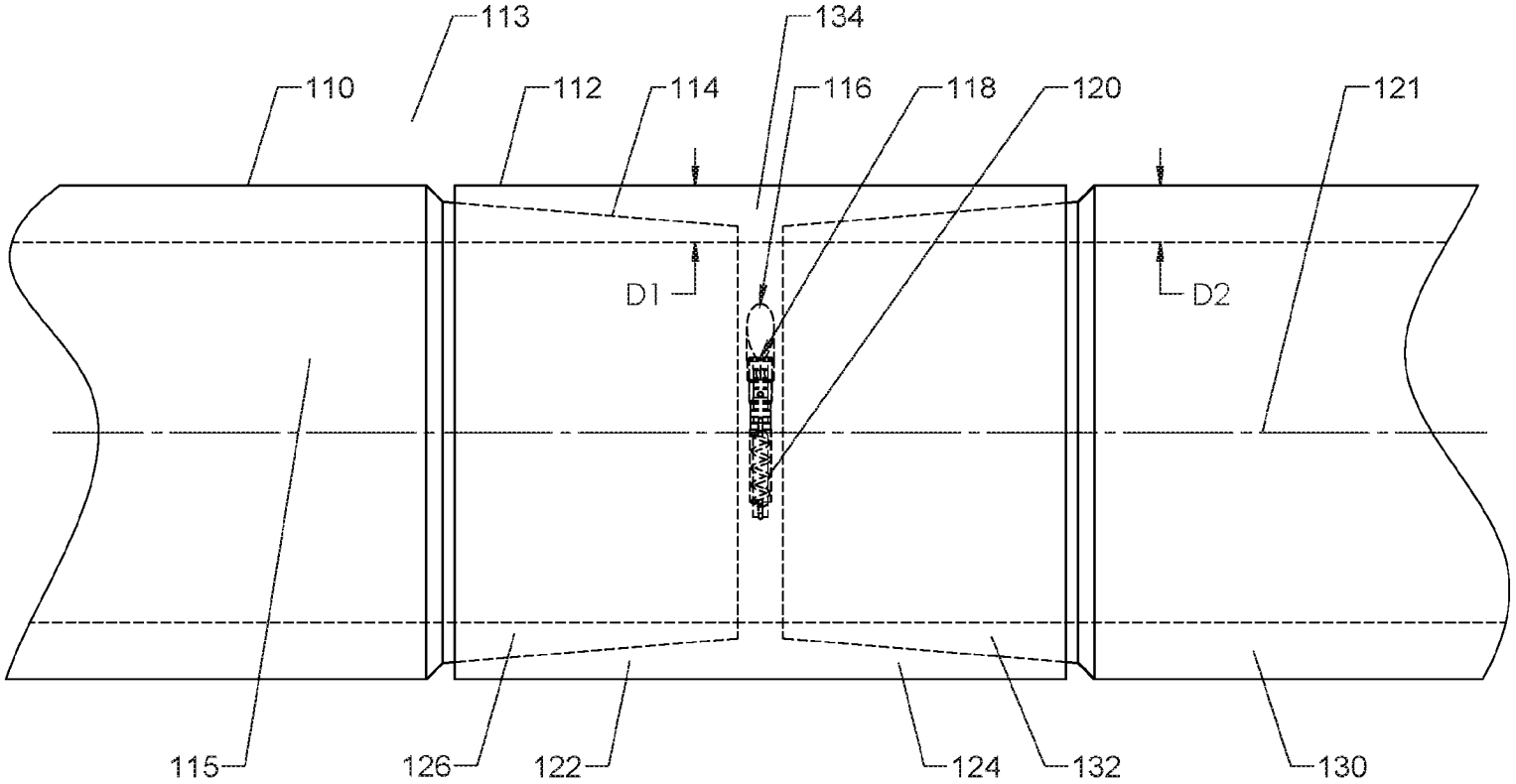
FIG. 2 depicts a coupling having a tubular threaded into each end thereof where the coupling includes an inflow control device.
Figure 3:
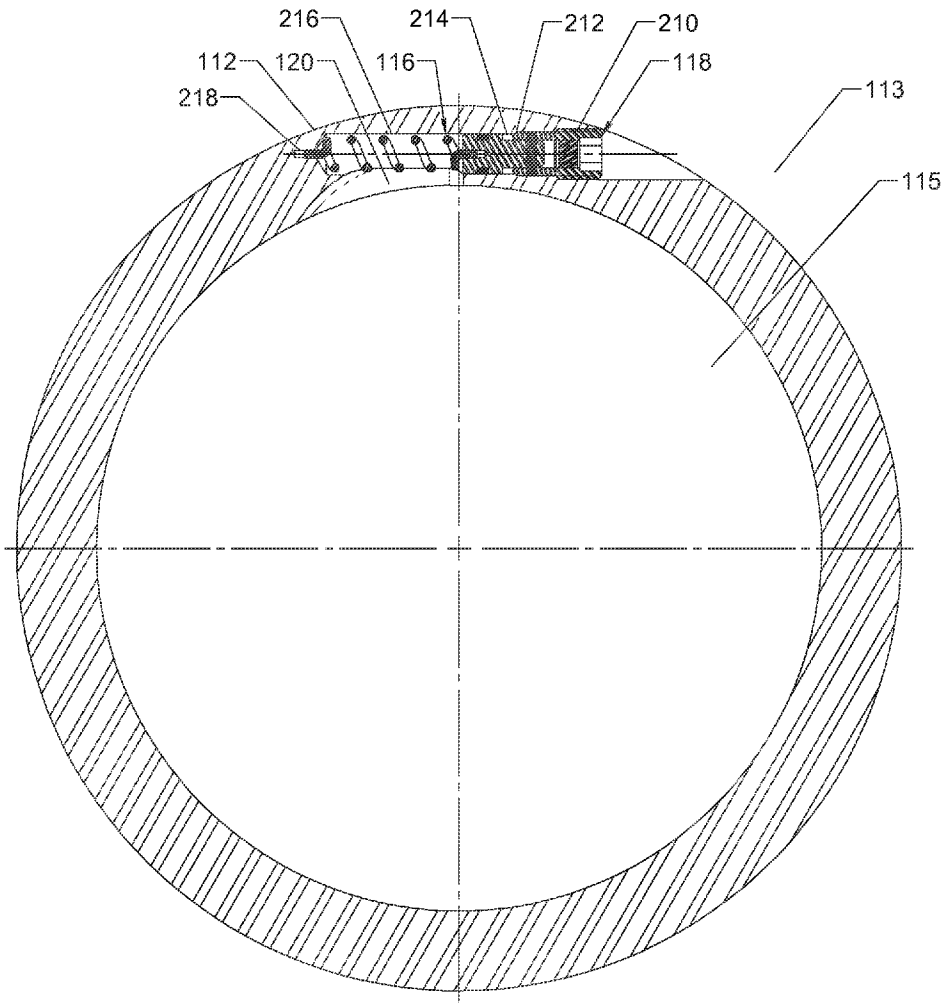
FIG. 3 depicts an end view of the coupling including an inflow control device.

As depicted in FIGS. 2 and 3 a second hole 120 is drilled through the wall of the coupling 112 which intersects the first hole 116 such that it permits communication of fluids between the tubing and annulus of the liner string. In certain instances the first hole may be drilled in to the coupling such that the first hole allows for fluid communication between the exterior of the coupling to the interior of the coupling through the first hole. In one embodiment an inflow control device is placed into the hole to moderate the fluid flow through the hole between the interior of the coupling and the exterior of the coupling.

The inflow control device 118 is placed inside the first hole 116, and once installed, creates a pressure barrier between the tubing 110 and coupling 112 assembly and the annular area 113 exterior of the tubing 110 and coupling 112 assembly while still sensing pressure from both the tubing interior 115 and the annular area 113. The inflow control device 118 typically is capable of withstanding cyclical, hydrostatic annular area pressure or the application of high pressure in the tubing interior 115. Typically such pressure cycles may be 3000 psi hydrostatic annular area 113 pressure or 3000 psi tubing interior 115 pressure for five cycles. The application of pressure in excess of the normally expected pressure should cause the inflow control device 118 to actuate, allowing at least some fluid communication between the tubing interior 115 and the annular area 113. Typically such excess pressure may be about 3,700 psi-5,000 psi before the tubing pressure causes the device to actuate, allowing fluid communication between tubing and annulus. Once actuated the inflow control device 118 creates a user-selectable orifice for flow restriction, which can be changed at any time prior to run-in. Typically the user selectable orifice may be between 4-6 millimeters.

Typically the coupling 112 is a standard casing coupling. The first hole is typically formed by drilling, milling, casting or any other means known in the art. The typical coupling 112 shown in FIG. 2 has a first box end 122, a second box end 124, and a center 121. A first tubing 110 has a first pin end 126 that is threadedly attached to the first box end 122 of the coupling 112. A second tubing 130 has a second pin end 132 that is threadedly attached to the second box end 124 of the coupling 112. Between the first box end 122 and the second box end 124 the coupling 112 typically has a region 134 that has about the same wall thickness D1 as the wall thickness D2 as the tubings 110 and 130. The first hole 112 is typically formed in the coupling 112 in the region 134.

Figure 4:
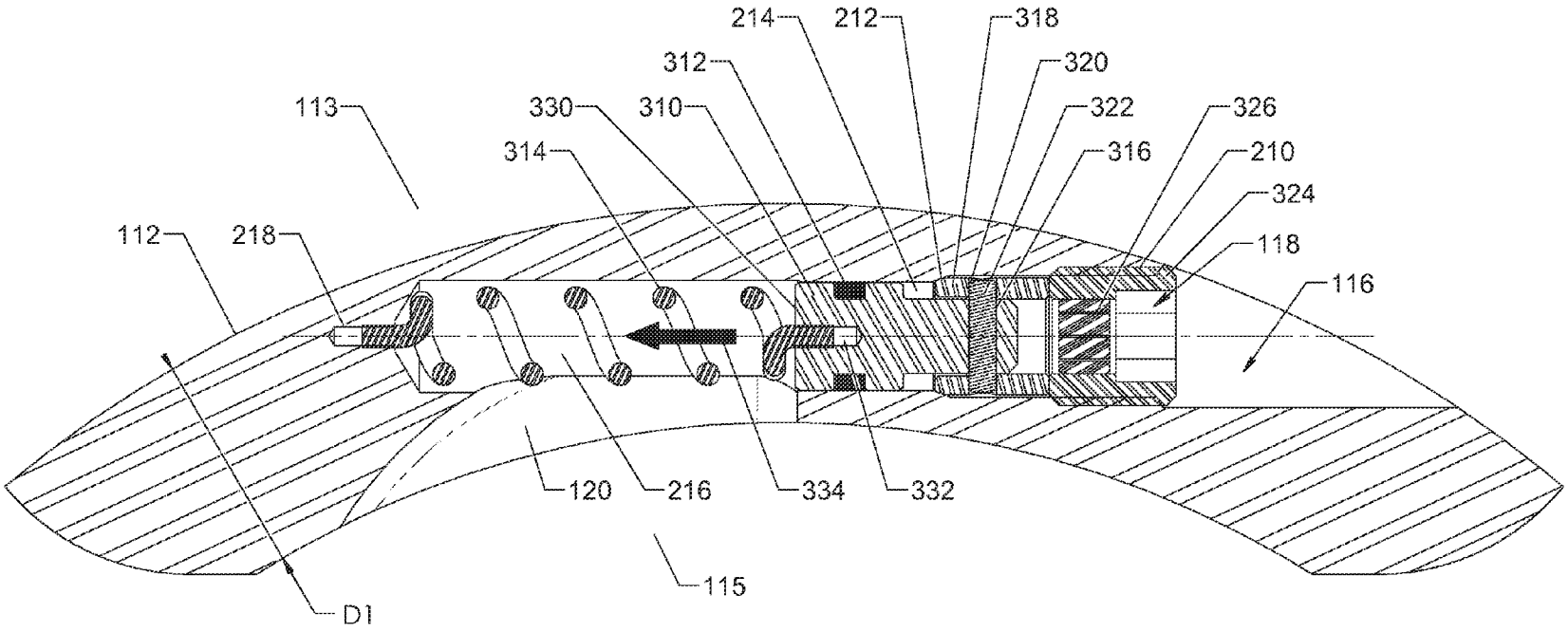
FIG. 4 depicts a portion of a coupling with a closeup view of an inflow control device prior to actuation.
Figure 5:
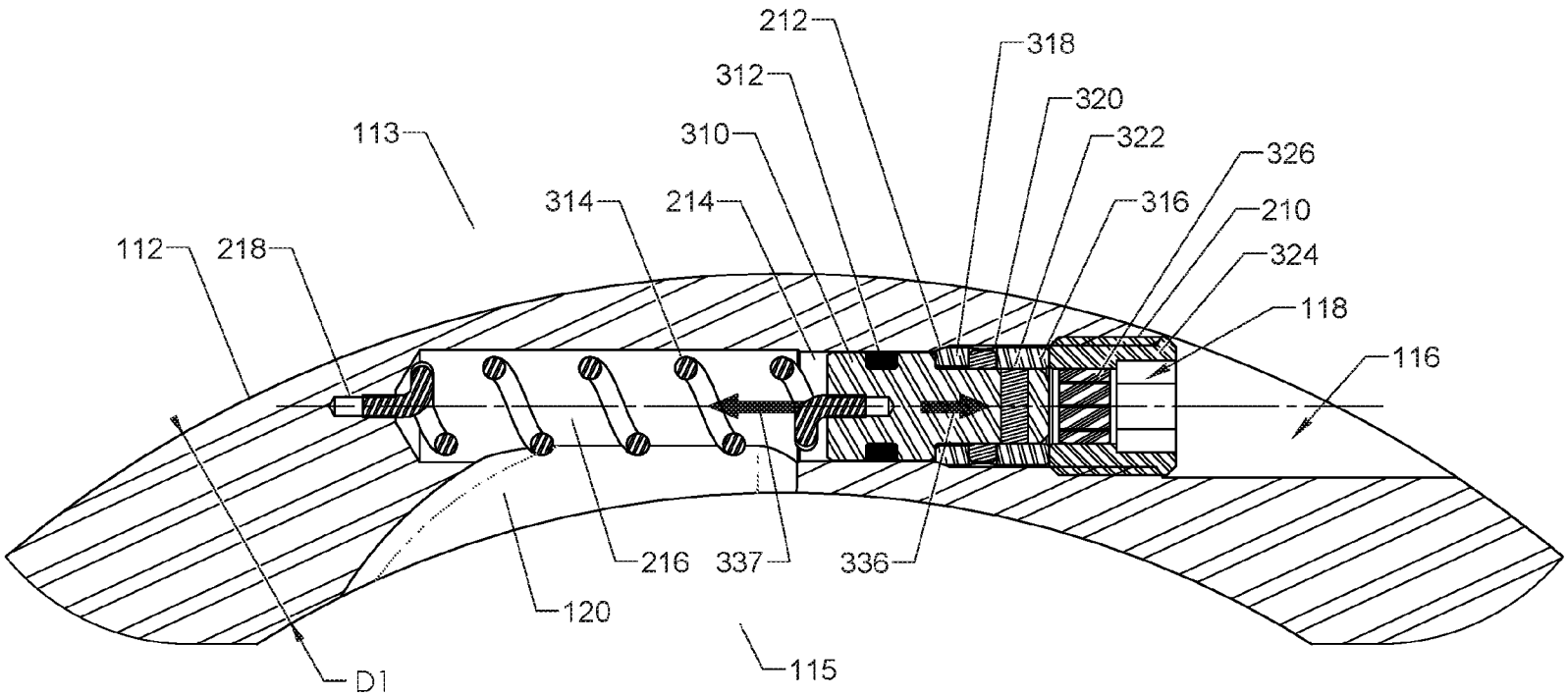
FIG. 5 depicts a portion of a coupling with a closeup view of an inflow control device where pressure is being exerted upon the piston from the interior of the tubular thereby shearing the shear pin.
Figure 6:
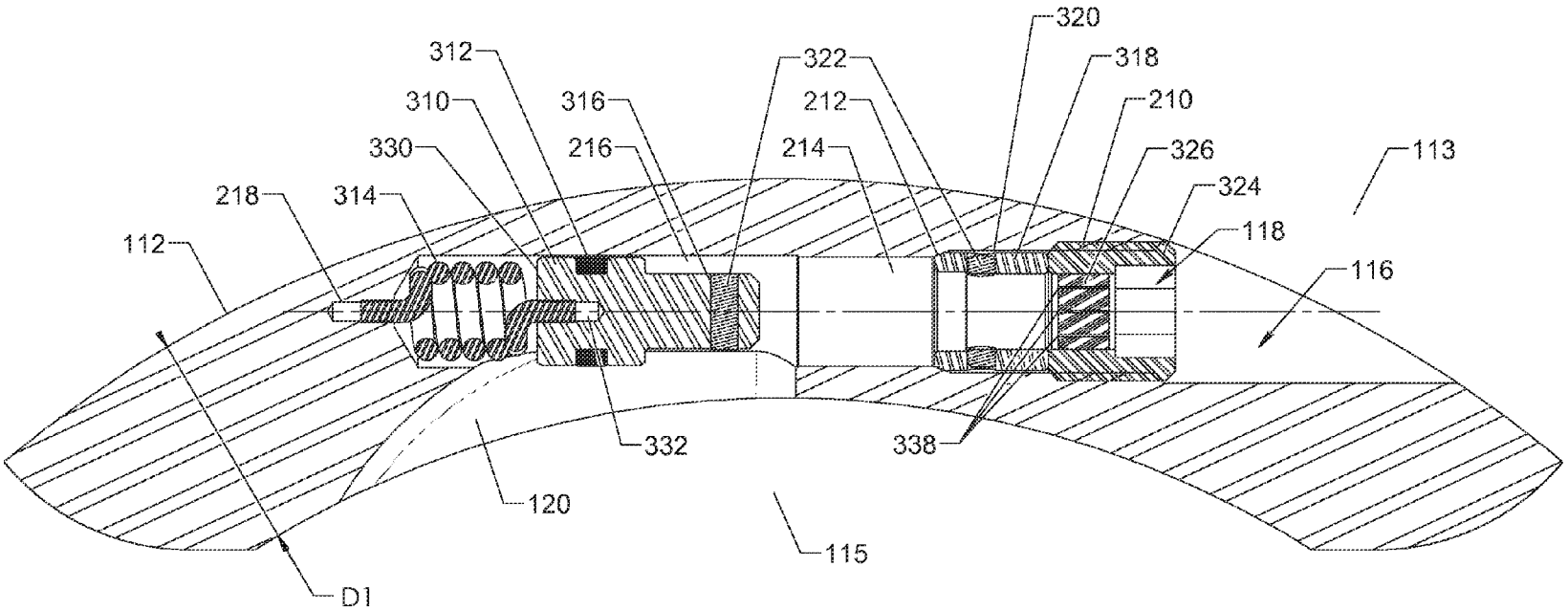
FIG. 6 depicts a portion of a coupling with a closeup view of an inflow control device after pressure from the interior of the tubular has been relieved allowing the bias device to remove the piston from the housing throughbore.

FIGS. 4-6 depict an embodiment of an inflow control device 118 in coupling 112. A first hole 116 is formed in the region 134 of the coupling 112. In certain instances the first hole 116 may be cut full bore or partial bore through the coupling 112 with a plug inserted from the opposing end to plug at least a portion of the bore and in many instances may provide an anchor for the spring 314, such as a second female thread 218 or a ferrule. The first hole 116 typically consists of a first female thread 210, an angled shoulder 212, a hone bore 214, a hone relief bore 216, and a second female thread 218. A second hole 120 has been cut through the wall of the coupling 112 such that it intersects the first hole 116 to permit fluid communication between the tubing interior 115 and annular area 113.

A piston 310 with a seal 312 is placed in the hone bore 214 of the first hole 116 such that it creates a pressure barrier between tubing interior 115 and annular area 113. The front face 330 of piston 310 has a bore 332 having a female thread. A spring 314 may be threadedly attached to the bore 332 of the piston 310. In the first state, depicted in FIG. 4, the spring 314 is extended and exerts an axial force on the piston 310 as depicted by arrow 334. There is a radial hole 316 through the piston 310. Towards the annular area 113 adjacent to piston 310, a shear sleeve 318 is mated against the angled shoulder 212. The shear sleeve 318 has a radial hole 320 through its wall which aligns with the radial hole 316 in the piston 310. A shear pin 322 is placed through the mating holes 316 and 320. Towards the annular area 113 adjacent to shear sleeve 318, a flow nozzle 324 with a male thread is threaded into the female thread 210. The flow nozzle 324 may have an internal diameter sized to restrict fluid flow between the tubing interior 115 and annular area 113 of the well to a desired rate. This internal diameter can be adjusted based on the requirements of a specific well environment. An erodible and/or dissolvable metering disk 326 may reside in the internal diameter of the flow nozzle 324. The metering disk 326 may have one or more holes through it to permit fluid communication between the tubing interior 115 and annular area 113. The flow nozzle 324 is threaded into the first hole 116 such that it is adjacent to shear sleeve 316. The flow nozzle 324 locks all internal parts in place within the coupling 112. Various sizes of flow nozzles 324 can be used, and can be interchanged at any time without affecting operation of the device 118, without requiring disassembly of the device 118, and without the need for specialized tooling.

Pressure applied to the annular area 113 of the well acts on the piston 310 creating an axial force in the direction of arrow 334 on piston 310 which tends to shear the shear pin 320. The shear pin 320 is sized such that it can withstand constant applied pressure from the annular area 113 without actuating the inflow control device 118. Typically the shear pin is sized such that it can withstand about 3,000 psi constant applied pressure from the annular area 113 without actuating the inflow control device 118.

FIG. 5 depicts an intermediate position of the inflow control device 118 where pressure applied to the tubing interior 115 acts on the front face 330 of piston 310. This pressure creates an axial force on the piston 310 in the direction of arrow 336 which tends to shear the shear pin 320. The shear pin 320 is sized such that it can withstand about 3,000 psi applied pressure from the tubing interior 115 five times without being sheared. However, when higher pressure, typically between 3,700 and 5,000 psi, is applied to the tubing, the shear pin 320 shears, allowing the piston 310 to travel outward while maintaining a seal in its hone bore 214. The piston 310 travels outward until it shoulders against the shear sleeve 316. In this condition, the inflow control device 118 continues to maintain the seal between the tubing interior 115 and the annular area 113 as long as tubing pressure is maintained. Decreasing pressure in the tubing interior 115 causes a decreasing outward force in the direction of arrow 336 on the piston 310, allowing the spring 314 to pull, as indicated by arrow 337, the piston 310 away from the annular area 115 until the seal 312 is past the end of the hone bore 214 and is inside the hone relief bore 216. At this point, fluid communication is achieved between the tubing interior 115 and annular area 113.

As depicted in FIG. 5 the spring 314 continues to pull the piston 310 inward until the spring reaches its relaxed state. At this point, the piston 310 is far enough away from the annular area 113 that full flow capacity is achieved between the tubing interior 115 and annular area 113, with the flow nozzle 324 acting as the primary restriction in the system. Once fluid begins to flow across the metering disk 326, the metering disk 326 may begin to erode and/or dissolve. Because of the flow restriction created by the small holes 338 in the metering disk 326, prior to the metering disk 326 eroding or dissolving away, it may be possible to build pressure inside the tubing even if a number of devices 118 in the completion string have opened and are communicating fluid between the tubing interior 115 and the and annular area 113. Thereby allowing the operator to develop sufficient pressure in the tubing interior 115 to ensure that all inflow control devices 118 in the well are actuated prior to full flow being established between the tubing interior 115 and annular area 113. Typically the metering disks 326 each erode and/or dissolve over a short period of time as a result of production through the completion string, leaving the flow nozzles 324 as the primary flow restrictions in the completion string.

Figure 7:
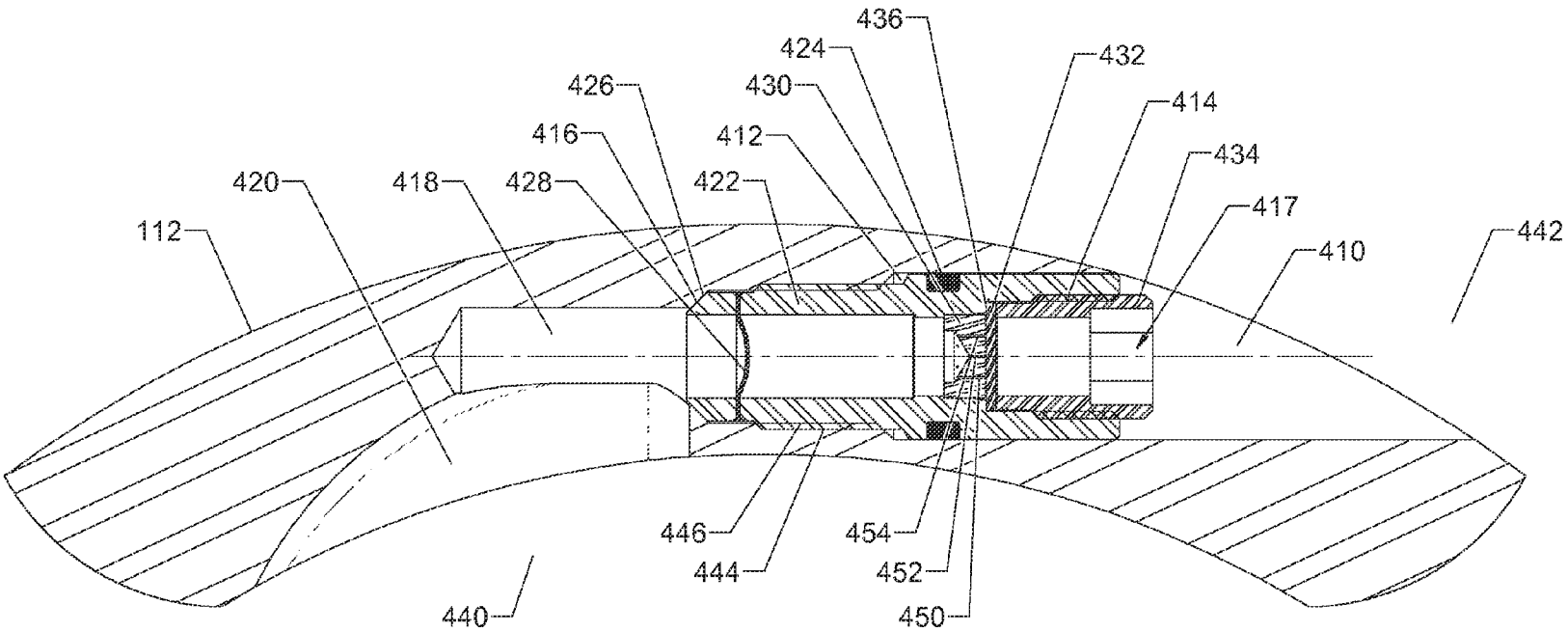
FIG. 7 depicts a portion of a coupling with a closeup view of an alternative inflow control device prior to actuation.
Figure 8:
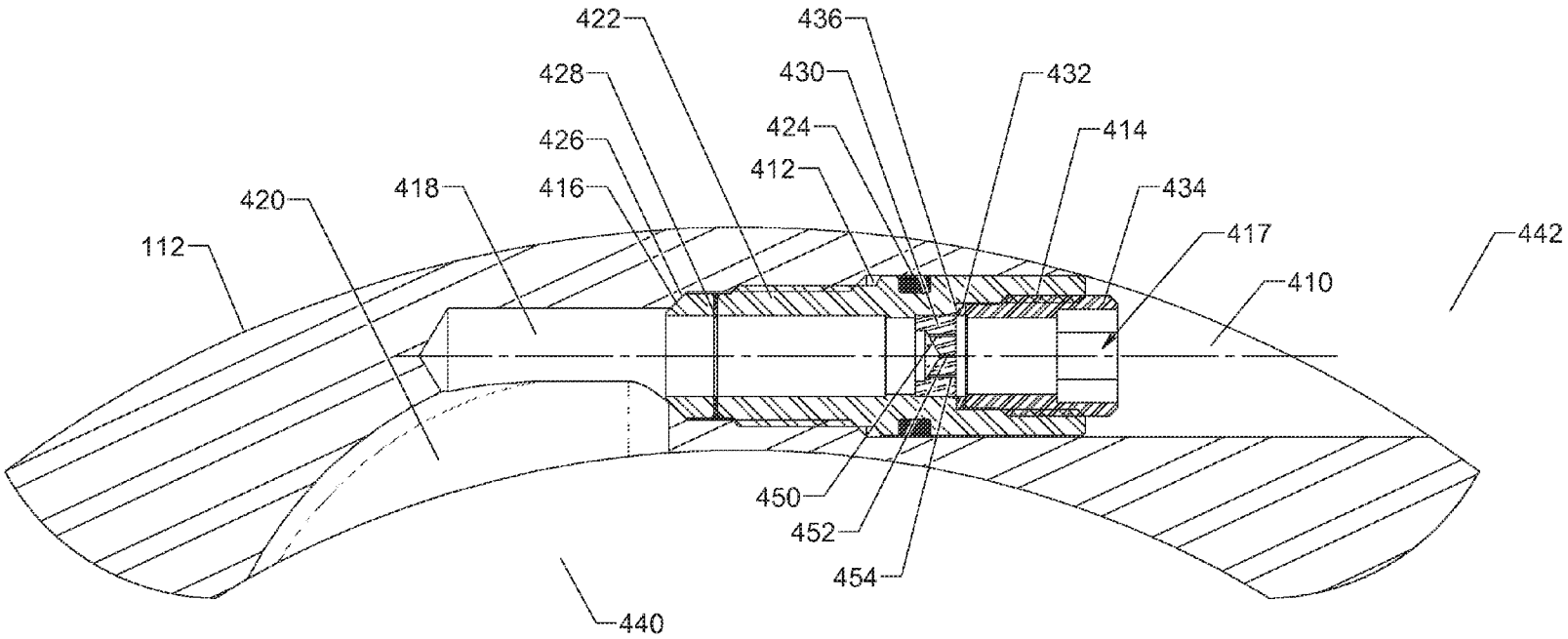
FIG. 8 depicts a portion of a coupling with a closeup view of an alternative inflow control device after pressure has been exerted upon the rupture disk from the interior of the tubular and the same fluid has passed through the holes in the support disc to remove the sealing disk from the through bore of the housing.

FIGS. 7 and 8 depict an alternate embodiment of an inflow control device 417. A port 410 placed in the wall of the coupling 112 consists of a hone bore 412, a female thread 444, an angled sealing shoulder 416, and a hole for fluid communication 418. A slot 420 has been cut through the wall of the coupling 112 such that it intersects the port 410 to permit fluid communication between the tubing interior 440 and annular area 442.

A housing 422 with a seal 424 and a male thread 446 is inserted into the port 410 in the coupling 112 such that it threads into a female thread 444 in the coupling 112, and its seal 420 resides in the hone bore 412. The housing 422 is threaded in and tightened until a metal-to-metal pressure seal is achieved between an angled nose of the housing 426 and the angled sealing shoulder 416. The housing 422 has an integral rupture device 428. A small erodible and/or dissolvable metering disk 430 has been press-fit into the end of the housing 422 nearest to the annular area 442. The metering disk 430 may have one or more holes such as holes 450, 452, and 454 through its thickness to permit fluid communication between the tubing interior 440 and annular area 442. A sealing disk 432 is placed inside the housing 410 adjacent to the metering disk 430. The sealing disk 432, housing 422, and seal 424, isolate pressure in the annular area 442 from the rupture device 428 and metering disk 430. Behind the sealing disk 432, a flow nozzle 434 with a male thread is threaded into the female thread 414 inside the housing 422. The flow nozzle 434 is tightened into the housing 422 such that the flow nozzle 434 creates a seal between itself and the sealing disk 432, as well as between the sealing disk 432 and a shoulder 436 inside the housing 422. The flow nozzle 434 has a specific internal diameter sized to restrict fluid flow between the tubing interior 440 and annular area 442 of the well to a desired rate. This internal diameter can be adjusted based on the requirements of a specific well environment. Various sizes of flow nozzles 434 can be used, and can be interchanged at any time without affecting operation of the device 118 and typically without the need for specialized tooling.

Pressure in the annular area 442 typically does not affect the inflow control device 118, as the rupture device 428 does not sense pressure from the annular area 442. The sealing disk 432 is supported by the metering disk 430, which allows the sealing disk 432 to seal pressure in the annular area 442 without yielding. Therefore, pressure can be applied to the annular area 442 as needed without actuating the inflow control device 118.

Pressure applied to the tubing interior 440 acts on the side of the rupture device 428 that is exposed to the tubing interior 440. The rupture device 428 is typically sized such that a designated pressure may be applied to the tubing over many cycles without affecting the rupture disk 428. However, when a pressure in excess of the designated pressure is applied, the rupture disk 428 ruptures in a controlled and predictable manner.

As depicted in FIG. 8, once the pressure limit of the rupture disk 428 is reached, the rupture disk 428 ruptures, allowing fluid to flow through the metering disk 430. The fluid communication holes 450, 452, and 454 in the metering disk 430 permit fluid from the tubing interior 440 to apply pressure to the sealing disk 432, which is not supported towards the annular area 442. Therefore the sealing disk 432 breaks or otherwise be removed as pressure is applied from the tubing interior 442 establishing fluid communication between the tubing interior 440 and annular area 442.

Typically the metering disk 430 is made of an erodible and/or dissolvable material such as polyglycolic acid. Fluid flow in either direction across the metering disk 430 tends to erode and/or dissolve the metering disk 430 at a predictable rate. Prior to the metering disk 430 eroding and/or dissolving, pressure can still be built up in the tubing interior 440 because of the temporary flow restriction created by the small holes 450, 452, and 454 in the metering disk 430, allowing the operator to develop sufficient pressure in the tubing interior 440 to ensure that all inflow control devices 118 in the completion string may be actuated prior to full flow being established between the tubing and annulus. The metering disks 430 then erode over a time as a result of production through the completion string, leaving the flow nozzle 434 as the primary flow restriction in the completion string.

Typically the rupture disk 428 is sized such that 3,000 psi may be applied to the tubing interior 440 about five times. The rupture disk 428 ruptures in a controlled and predictable manner when between 3,700 and 5,000 psi is applied to the tubing interior 440.

Figure 9:
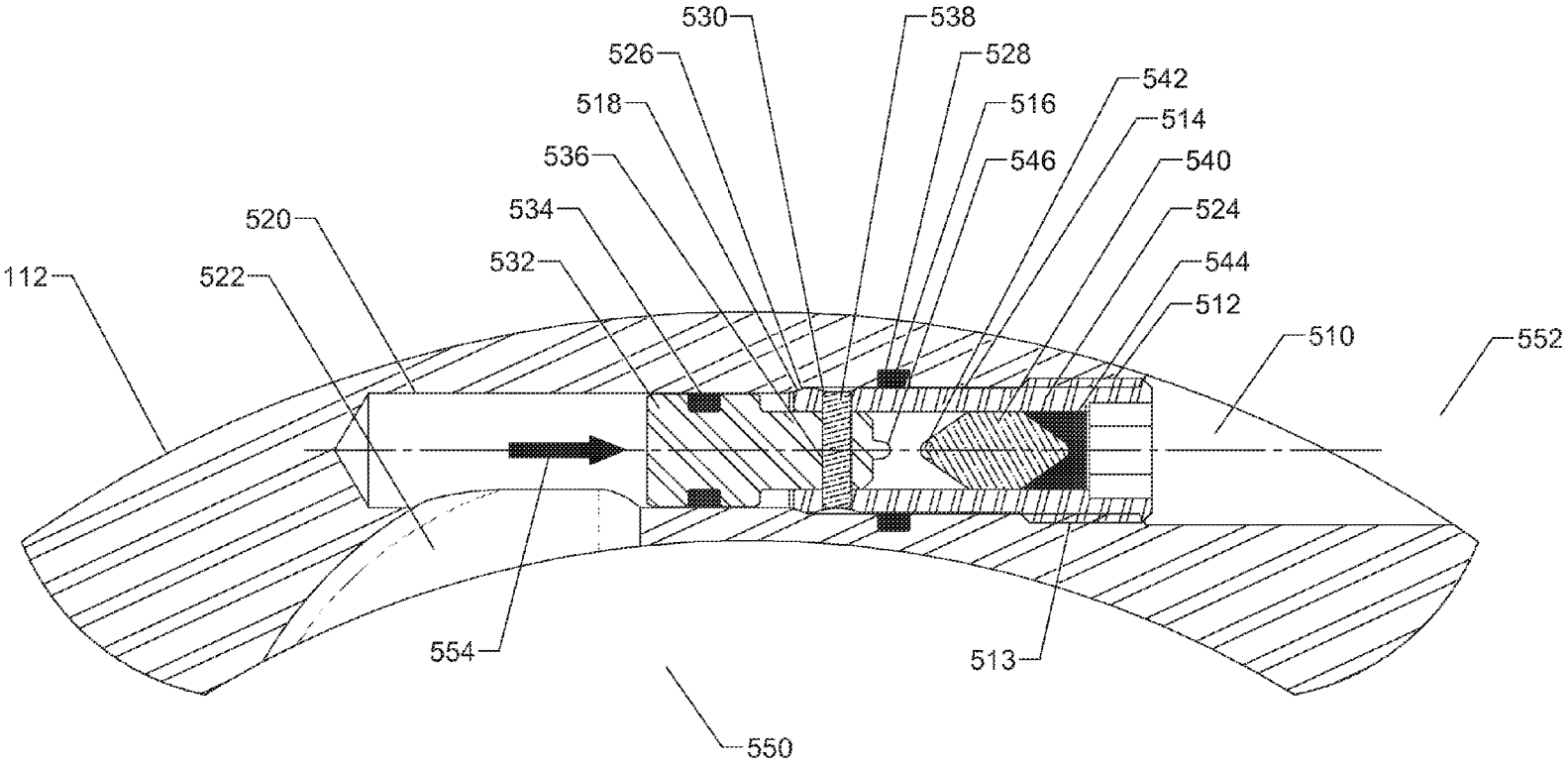
FIG. 9 depicts a portion of a coupling with a closeup view of another alternative inflow control device prior to actuation.
Figure 10:
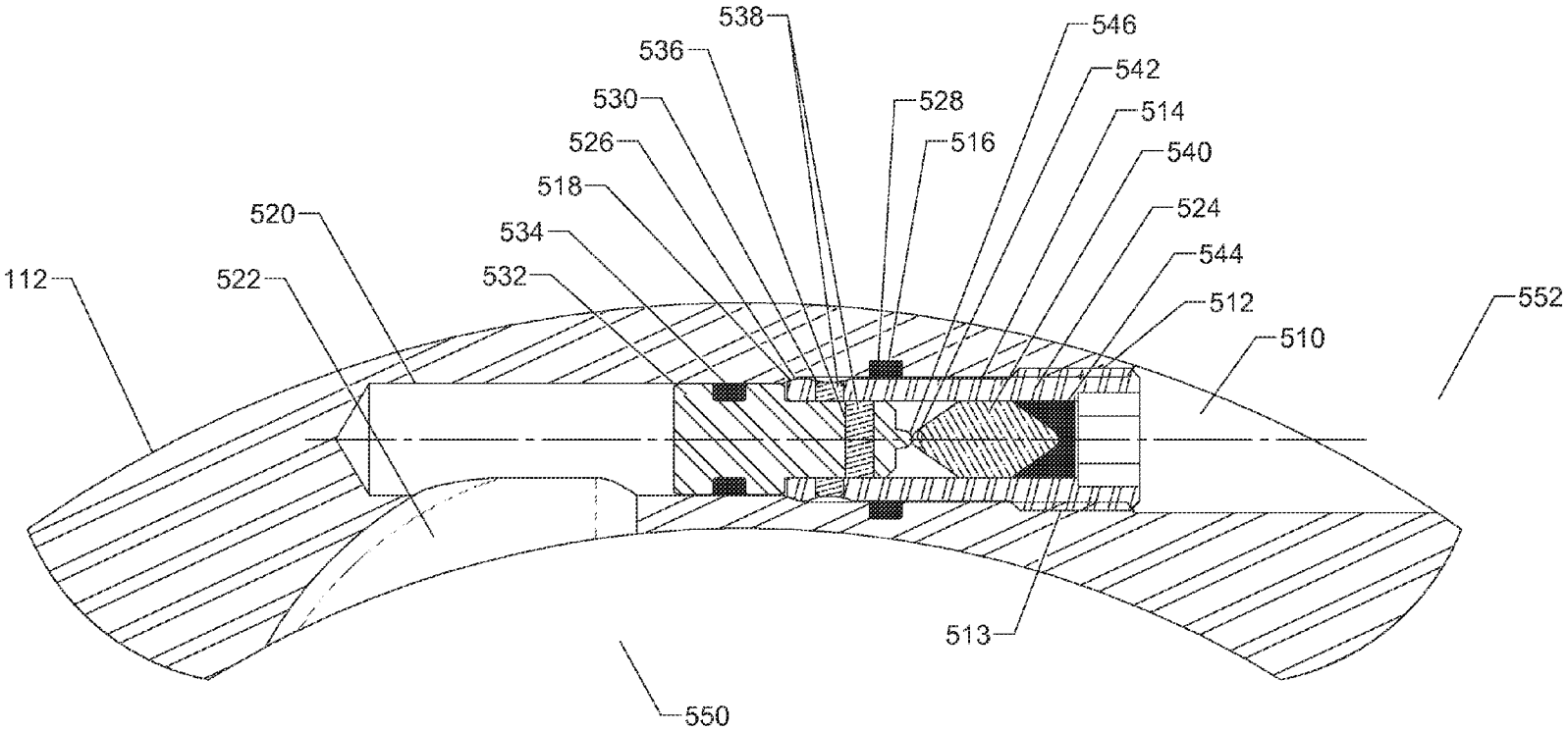
FIG. 10 depicts a portion of a coupling with a closeup view of another alternative inflow control device after sufficient pressure has been applied from the interior of the tubing to shear the shear pin and allow the piston to contact the primer.
Figure 11:
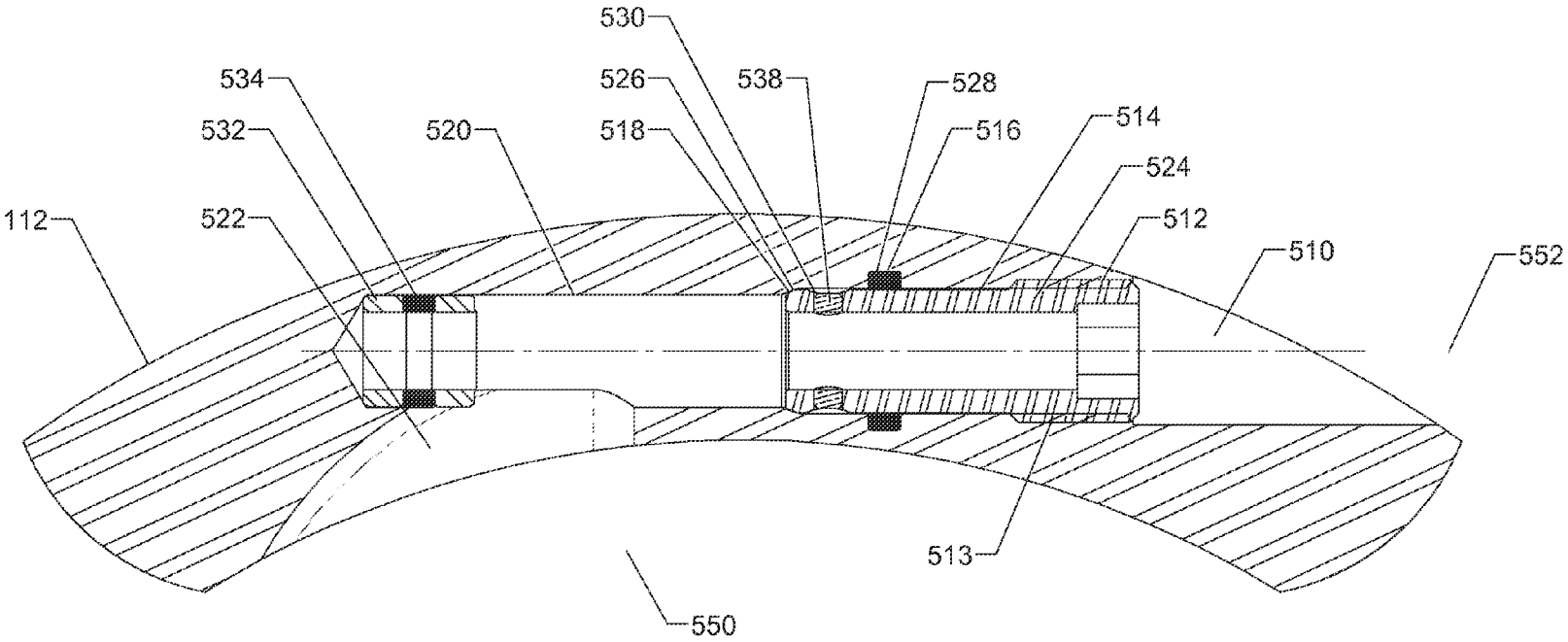
FIG. 11 depicts a portion of a coupling with a closeup view of another alternative inflow control device after the explosive charges detonated thereby removing the charge seal and the piston from the housing through bore.

An alternate embodiment is depicted in FIGS. 9-11. A port 510 formed in the wall of the coupling 112 consists of a female thread 512, a bore 514 with a seal groove 516, an angled shoulder 518, and a hone bore 520. A slot 522 has been cut through the wall of the coupling 112 such that it intersects the port 510 to permit fluid communication between the tubing interior 550 and annular area 552.

A housing 524 with a male thread 513 is threaded into the female thread 512 in the port 510 until the angled shoulder 526 on the housing 524 mates against the angled shoulder 518. A seal is created between the outer diameter of the housing 524 and a housing seal 528 that resides in the seal groove 516. A first radial hole 530 has been drilled through the housing 524. A piston 532 with a piston seal 534 is located inside the hone bore 520. A second radial hole 536 has been drilled through the end of the piston 532. The piston 532 is located such that the second radial hole 536 is aligned with the first radial hole 530. A shear pin 538 is inserted through first radial hole 530 and second radial hole 536, locking the piston 532 and housing 524 together. An explosive charge 540, such as a shaped charge, with an integral primer 542 is inside the housing 524 such that the primer 542 faces the piston 532. A charge seal 544 is located behind the explosive charge 540. The charge seal 544 forms a seal inside the inner diameter of the housing 524. The piston 532 has a small protrusion 546 on its outer face that is designed to engage the primer 542 on the explosive charge 540.

Pressure applied to the annular area 552 of the well does not affect the inflow control device, as the housing seal 528 and charge seal 544 create pressure barriers inside the port 510. Therefore, pressure can be applied to the annular area 552 without actuating the inflow control device.

Pressure applied to the tubing interior 550 of the well acts upon the piston 532. This pressure creates a force on the piston 532, in the direction of arrow 554, which tends to shear the shear pin 538. The shear pin 538 is sized such that it can withstand pressure applied from the tubing interior 550 over several cycles without being sheared. Typically the shear pin 538 is sized such that it can withstand about 3,000 psi applied pressure from the tubing interior 550 about five times without shearing. However, when higher pressure is applied to the tubing, the shear pin 538 shears, allowing the piston 532 to travel outward while maintaining a seal in the hone bore 520. Typically, the shear pin 538 shears when pressure between 3,700 and 5,000 psi is applied to the tubing interior 550. The piston 532 travels outward until the protrusion 546 contacts the primer 542 on the explosive charge 540. When the protrusion 546 contacts the primer 542, it ignites the explosive charge 540, which applies pressure to create a hole through the piston 532, as well as eliminate the charge seal 544. At this point, fluid communication between the tubing an annulus is achieved, with the inner diameter of the housing 524 functioning as the primary flow restriction in the completion string.

Bottom, lower, or downward denotes the end of the well or device away from the surface, including movement away from the surface. Top, upwards, raised, or higher denotes the end of the well or the device towards the surface, including movement towards the surface. While the embodiments are described with reference to various implementations and exploitations, it is understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A downhole device comprising:

a tubular having, a center, an exterior surface, and an interior surface;

a port connecting the interior surface with the exterior surface;

an inflow control device is secured in the port;

wherein the inflow control device has a throughbore; and further wherein the throughbore has a piston located in the throughbore;

wherein the piston is secured in the throughbore of the inflow control device by a shear device;

further wherein the shear device may be sheared by fluid acting on the piston from the interior of the tubular.

2. The downhole device of claim 1, wherein the piston is in fluid communication with the interior surface of the tubular and the exterior surface of the tubular.

3. The downhole device of claim 1, wherein the piston is biased against fluid flow from the interior of the tubular.

4. The downhole device of claim 1, wherein the port is generally perpendicular to the fluid flow through the tubular.

* * * * *